US008287122B2

(12) United States Patent
Yonekawa et al.

(10) Patent No.: US 8,287,122 B2
(45) Date of Patent: Oct. 16, 2012

(54) IMAGE FORMING APPARATUS

(75) Inventors: Masahiro Yonekawa, Machida (JP); Masato Suzuki, Kawasaki (JP); Ryota Yano, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 486 days.

(21) Appl. No.: 12/458,619

(22) Filed: Jul. 17, 2009

(65) Prior Publication Data

US 2010/0013901 A1 Jan. 21, 2010

(30) Foreign Application Priority Data

Jul. 17, 2008 (JP) ..... 2008-186583

(51) Int. Cl.
*B41J 29/13* (2006.01)

(52) U.S. Cl. ..... 347/108

(58) Field of Classification Search ..... None
See application file for complete search history.

(56) References Cited

U.S. PATENT DOCUMENTS

| | | | | |
|---|---|---|---|---|
| 5,915,157 | A | 6/1999 | Takenaka et al. | |
| 5,930,561 | A | 7/1999 | Hosokawa et al. | |
| 6,057,936 | A | 5/2000 | Obara et al. | |
| 6,131,902 | A | 10/2000 | Takenaka et al. | |
| 6,382,858 | B1 * | 5/2002 | Nojima et al. | 400/691 |
| 6,487,612 | B1 * | 11/2002 | Sueyoshi et al. | 710/14 |
| 6,507,720 | B2 | 1/2003 | Kabumoto et al. | |
| 2002/0009310 | A1 | 1/2002 | Kabumoto et al. | |
| 2002/0030724 | A1 * | 3/2002 | Shimoda | 347/108 |
| 2002/0043910 | A1 | 4/2002 | Hashimoto et al. | |
| 2006/0209104 | A1 * | 9/2006 | Naruse | 347/8 |
| 2007/0139506 | A1 | 6/2007 | Yonekawa | |
| 2007/0140708 | A1 | 6/2007 | Yonekawa et al. | |
| 2007/0140731 | A1 | 6/2007 | Yonekawa | |
| 2007/0236552 | A1 | 10/2007 | Suzuki et al. | |
| 2008/0246826 | A1 | 10/2008 | Yonekawa | |

FOREIGN PATENT DOCUMENTS

| | | |
|---|---|---|
| JP | 08-234622 | 9/1996 |
| JP | 2001-279743 | 10/2001 |
| JP | 3773246 | 2/2006 |

OTHER PUBLICATIONS

Abstract of JP 2004-163067 published Jun. 10, 2004.

* cited by examiner

*Primary Examiner* — Stephen Meier
*Assistant Examiner* — Tracey McMillion
(74) *Attorney, Agent, or Firm* — Harness, Dickey & Pierce, P.L.C.

(57) ABSTRACT

An image forming apparatus in which unintentional operation of the operation unit does not occur when sheets on which images have been formed or sheets prior to image forming or the like are placed on the top surface of the main body of the apparatus. The operation unit and a bearing are connected by a linking member. The operation unit can be disposed further forward than the carriage, so the distance between the operator and the operation unit is small, the operation is thereby made easier. The operation unit can be disposed closer to the center of the apparatus than the position of the carriage when it has moved as far as possible to the operation unit side, so the width of the whole recording apparatus can be made narrower. The operation unit rotates about a rotation shaft, so no matter what specific position the operation unit is located in, the operation unit is lower than the top surface of the apparatus main body. Therefore, when sheets on which images have been formed or sheets prior to image forming or the like are placed on the top surface of the main body of the apparatus, unintentional operation of the operation unit does not occur.

14 Claims, 8 Drawing Sheets

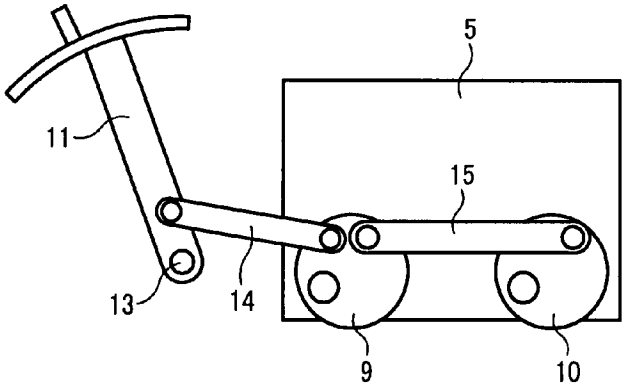
FIG. 3
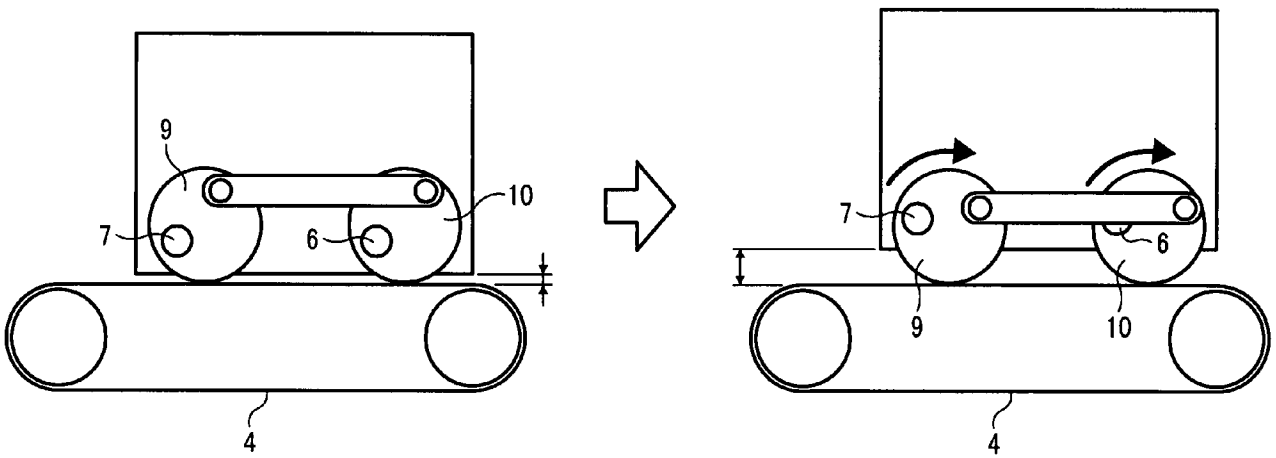
FIG. 4A
FIG. 4B

IMAGE FORMING APPARATUS

BACKGROUND OF THE INVENTION

1. Field of the Invention

The present invention relates to an image forming apparatus such as an inkjet printer and a laser printer, in which objects can be placed on the top of the main body of the apparatus, and more particularly to an image forming apparatus capable of preventing faulty operation or outputting faulty images due to erroneous operation of the operation unit thereof.

2. Description of the Related Art

Conventionally, in this type of image forming apparatus having an operation unit on the top surface of the apparatus, if sheets on which images have been formed or sheets for image forming are placed on the top surface of the apparatus, and if these sheets unintentionally touch the operation unit, the levers or the like of the operation unit can be operated without the user noticing it, which has the problem that the apparatus carries out an operation that is different from that which the user intended.

Technologies relating to the present invention are disclosed in, for example, Japanese Patent Application Laid-open No. H08-234622, Japanese Patent Application Laid-open No. 2001-279743, and Japanese Patent No. 3773246.

SUMMARY OF THE INVENTION

With the foregoing problem of the conventional art in view, it is an object of the present invention to provide an image forming apparatus in which if sheets on which images have been formed or sheets for image forming or the like are placed on the top surface of the main body of the apparatus, unintentional operation of the operation unit does not occur, and changing the settings of the apparatus without the user noticing it, and carrying out an operation that is different from that which the user intended does not occur.

In an aspect of the present invention, an image forming apparatus comprises a flat portion forming substantially the entire top surface of a main body thereof; and an operation unit provided lower than the flat portion of the top surface of the main body when the flat portion is in a specific stop position.

BRIEF DESCRIPTION OF THE DRAWINGS

The above and other objects, features, and advantages of the present invention will become more apparent from the following detailed description taken with the accompanying drawings, in which:

FIG. 3 is a diagram showing the relationship between a pair of guide shafts, the bearings, and the operation unit of this image forming apparatus;

FIGS. 4A and 4B are diagrams showing the relationship between the guide shafts and the platen belt;

DESCRIPTION OF THE PREFERRED EMBODIMENT(S)

Figure 1:
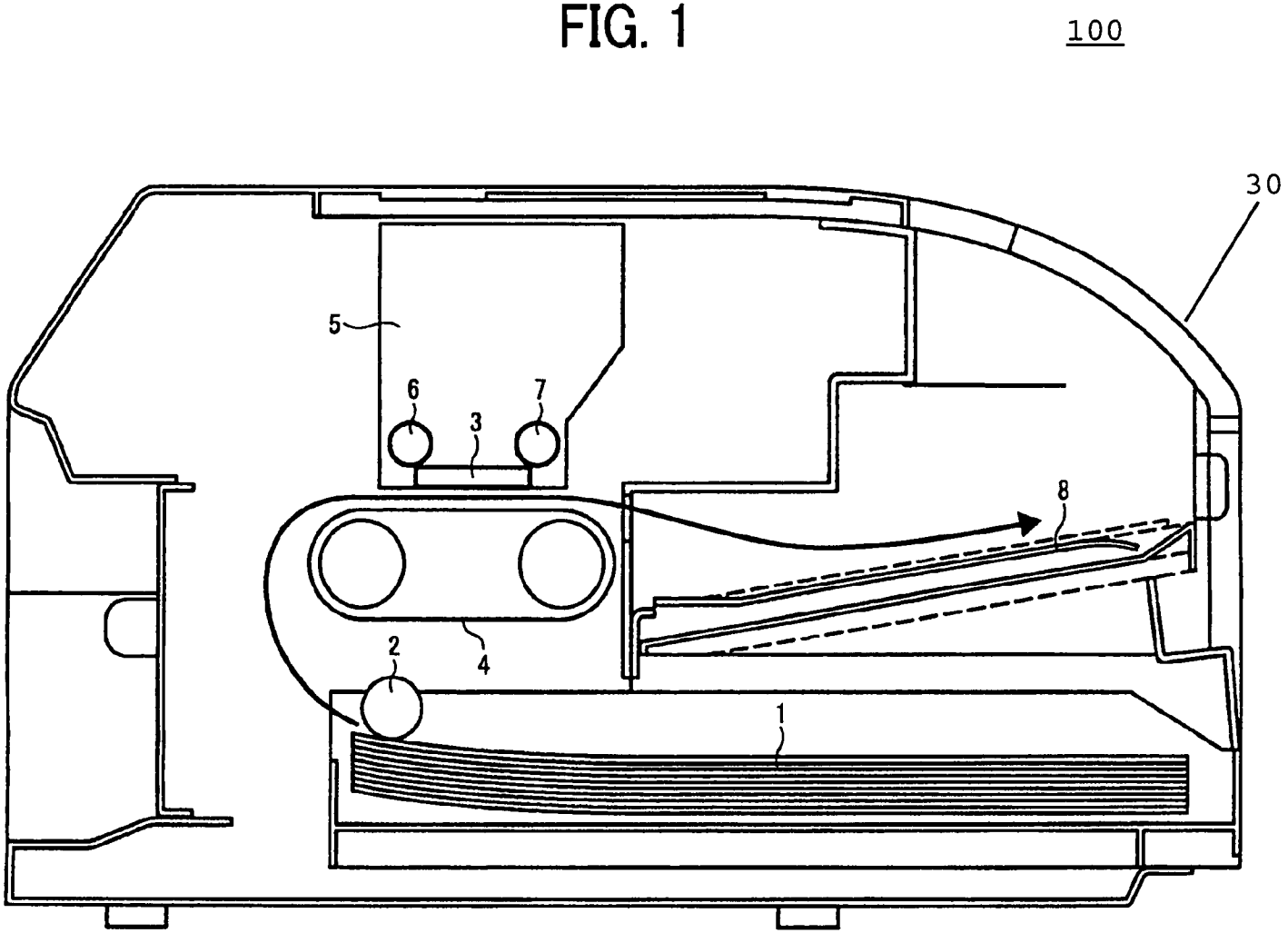
FIG. 1 is a cross-sectional diagram showing the constitution of Embodiment 1 of an image forming apparatus that can apply the present invention.

The following is an explanation of the best mode for carrying out the present invention with reference to each of the embodiments shown in the drawings. In each of the embodiments explained below, the example of a printer has been taken for explanation, but the present invention is not limited to a printer, but can be applied to various types of apparatus for forming images.

Embodiment 1

FIG. 1 shows an example of the constitution of an image forming apparatus 100 according to Embodiment 1 which can apply the present invention. In the image forming apparatus 100 according to an example embodiment, a recording medium 1 inserted in a sheet supply location is transported by transport rollers 2 to the area where recording can be carried out by a recording head 3. A platen belt 4 is provided in a position below the recording medium 1 in the area where recording can be carried out, and a carriage 5 is guided by a pair of guide shafts 6, 7 to move in the direction that the guide shafts 6, 7 extend (the main scan direction: the direction perpendicular to the plane of the paper in FIG. 1) and performs reciprocating scans over the recording area. The scan direction of the carriage 5 is the main scan direction, and the direction of transport of the recording medium 1 is the subsidiary scan direction.

A recording head unit 3 that includes a recording head 3 for ejecting ink droplets in a plurality of colors and a liquid storage unit for supplying ink to the respective recording heads is mounted on the carriage 5. In the present embodiment the plurality of colors is the four colors black (Bk), cyan (C), magenta (M), and yellow (Y). The position of each color is in random order, and is not limited to the example shown in the figures. After recording is completed, the recording medium 1 is discharged by the platen 4 onto a stacking platform 8.

Figure 2:
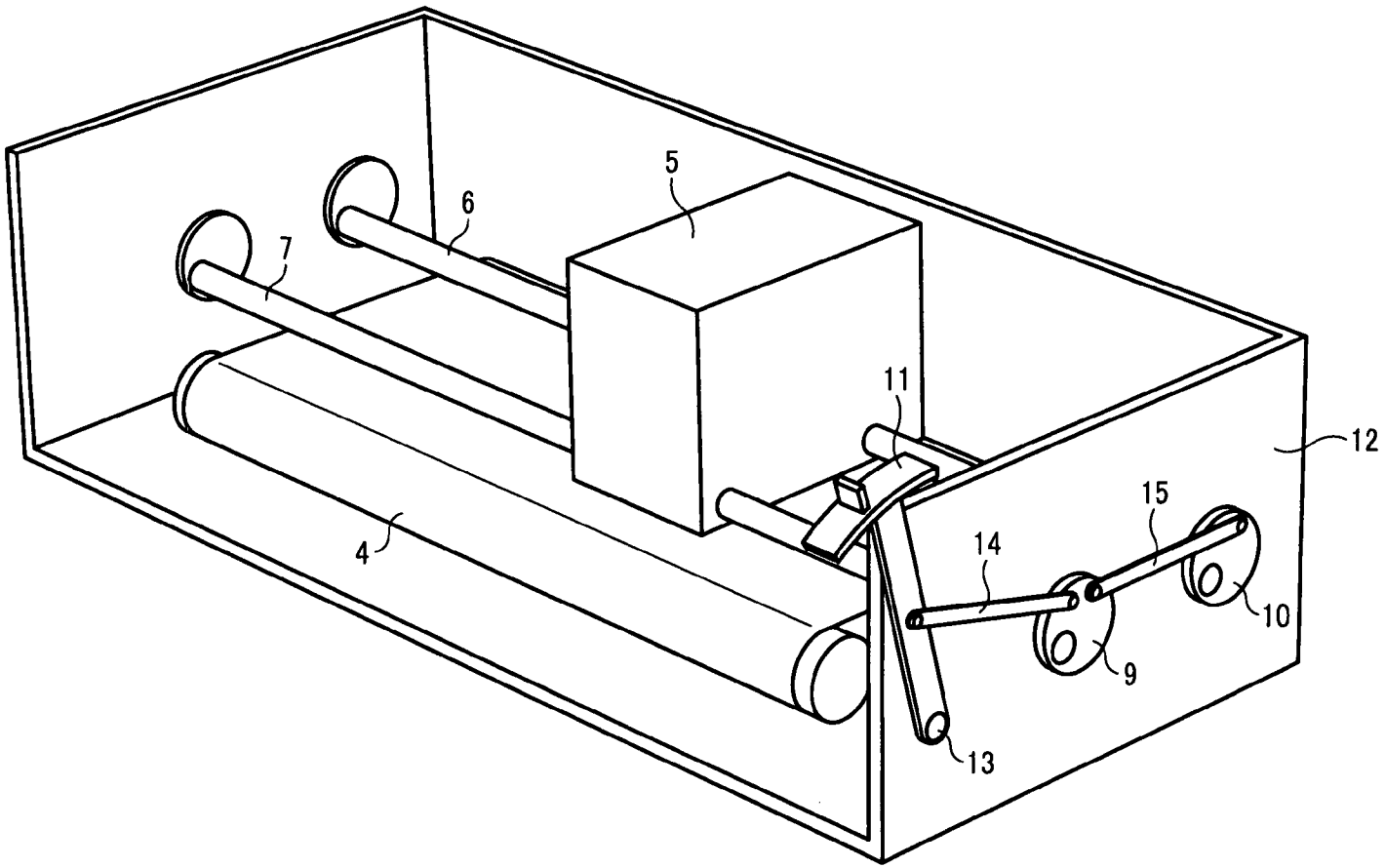
FIG. 2 is a perspective diagram showing the constitution of the recording unit of this image forming apparatus.

FIG. 2 shows the constitution of the recording unit of the image forming apparatus 100. The carriage 5 is guided by the pair of guide shafts 6, 7 to move in the direction that the guide shafts 6, 7 extend (the main scan direction) and performs reciprocating scans over the recording area. The scan direction of the carriage 5 is the main scan direction, and the direction of transport of the recording medium 1 is the subsidiary scan direction. The recording head unit 3 that includes the recording head for ejecting ink droplets in the plurality of colors and the liquid storage unit for supplying ink to the respective recording heads is mounted on the carriage 5. The two guide shafts 6, 7 are supported by bearings 9, 10 that can rotate in the sheet transport direction. Also, the bearings 9, 10 are rotatably supported by a side plate 12.

FIG. 3 shows the relationship between the two guide shafts 6, 7, the bearings 9, 10, and an operation unit 11. The operation unit 11 may be disposed between the carriage 5 and an operation panel 30 (shown in FIG. 1) of the apparatus main body. The operation unit 11 is connected to the side plate 12 by a rotation shaft 13, and the operation unit 11 and the bearing 9 are connected by a linking member 14. The connection portion between the bearing 9 and the linking member 14 can rotate, so that when the operation unit 11 is moved, the bearing 9 is rotated. The bearing 9 and the bearing 10 are joined by a linking member 15. The connection portions of the bearings 9, 10 and the linking member 15 can rotate, so the bearing 10 also rotates coupled with the rotation of the bearing 9.

FIGS. 4A and 4B show the relationship between the guide shafts 6, 7 and the platen belt 4. The two guide shafts 6, 7 are inserted at positions that are offset from the rotation centers of the bearings 9, 10, so when the bearings 9, 10 rotate, the distance between the two guide shafts 6, 7 and the platen belt 4 varies, as shown in the figure.

Figure 5:
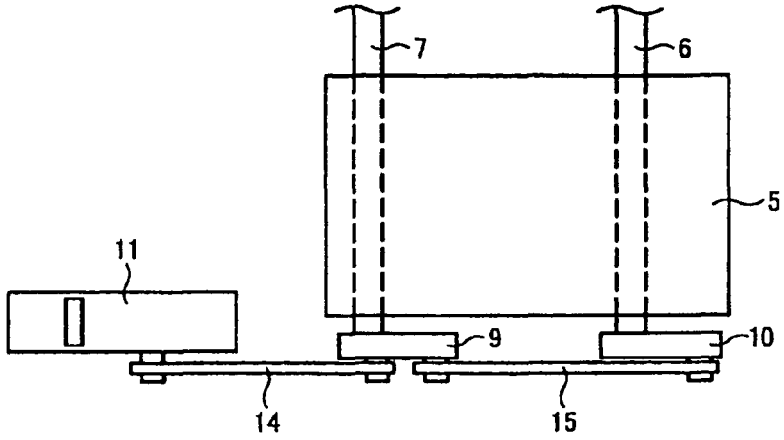
FIG. 5 is a diagram showing the mechanism shown in FIG. 3 viewed from above.

FIG. 5 shows the mechanism in FIG. 3 when viewed from above. By connecting the operation unit 11 and the bearing 9 with the linking member 14, it is possible to dispose the operation unit 11 to the front of the carriage 5. In this way, the distance between the operator and the operation unit 11 is small, so the apparatus is easy to operate. Also, it is possible to dispose the operation unit 11 closer to the center of the apparatus than the position of the carriage 5 when it has moved as far as possible to the operation unit 11 side, so it is possible to make the overall width of the apparatus narrower.

Figure 6A:
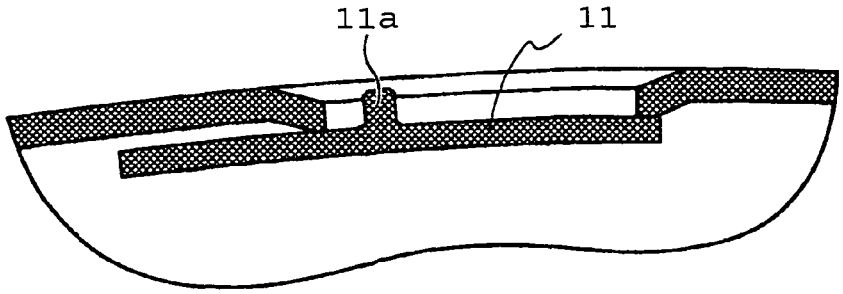
FIGS. 6A, 6B, 7, and 8 are diagrams showing the relationship between the operation unit and the top surface of the image forming apparatus main body.
Figure 6B:
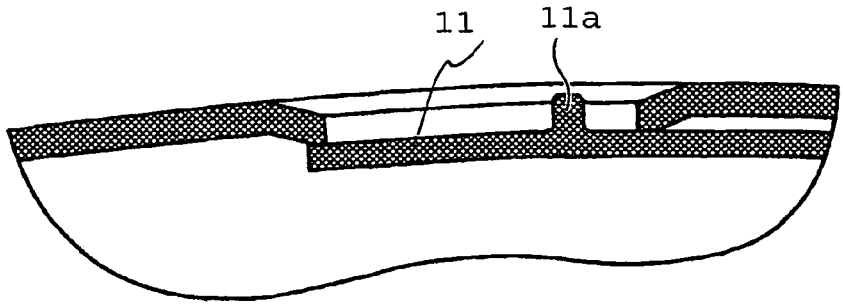

FIGS. 6A and 6B show the relationship between the operation unit 11 having an operation lever 11*a* and the top surface of the main body. The operation unit 11 can move in rotation due to the rotation shaft 13, so no matter what specific position the operation unit 11 is located in, the operation unit 11 (including the operation lever 11*a*) is below the top surface of the apparatus main body. Therefore, when sheets on which images have been formed or sheets for image forming or the like are placed on the top surface of the apparatus, the operation unit 11 is not unintentionally operated. Therefore, it is possible to prevent the settings of the apparatus from being changed without the user being aware of it, and prevent operation that is not intended by the user.

Figure 7:
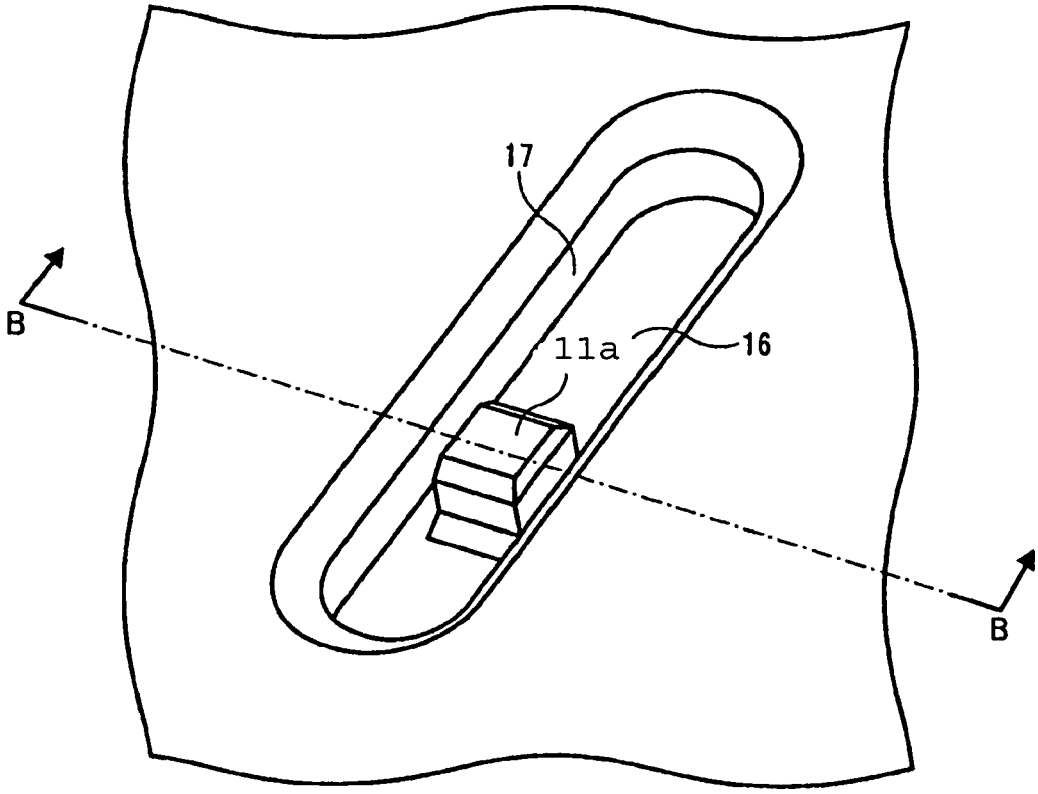
Figure 8:
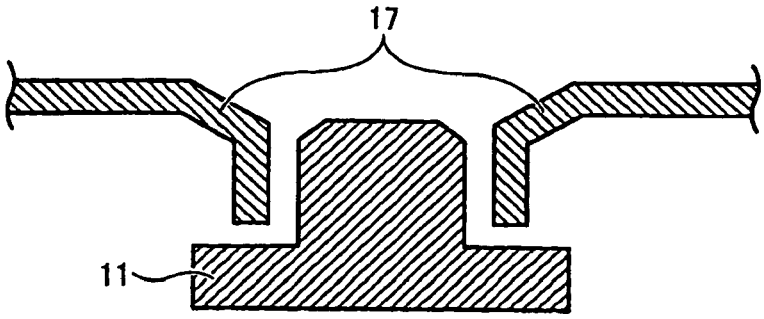

FIGS. 7 and 8 show the relationship between the operation unit 11 and the top surface of the main body. The operation unit 11 including the operation lever 11*a* is housed within a hole 16, and is operated by sliding within the hole 16. A sloping surface 17 is provided in the hole 16 in the top surface of the main body, so by widening the aperture, the user can easily grip the operation unit 11 even when the operation unit 11 is below the top surface of the main body.

Embodiment 2

Figure 9:
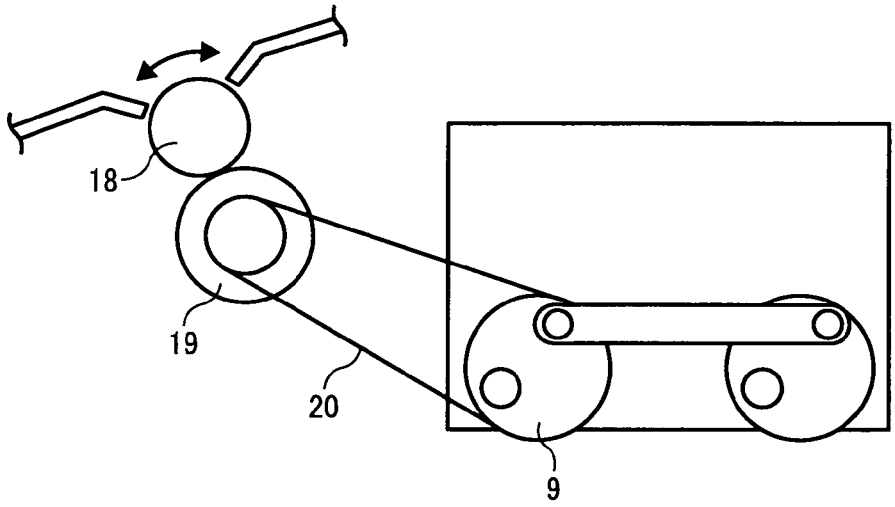
FIG. 9 is a diagram showing the relationship corresponding to FIG. 3 in Embodiment 2 of an image forming apparatus that applies the present invention.

FIG. 9 shows the relationship corresponding to FIG. 3 in Embodiment 2 of the present invention. In this embodiment, a dial 18 is provided instead of the operation unit 11. When the operator rotates the dial 18, a rotating gear 19 rotates, and the bearing 9 is rotated via a belt 20. In this way, even during operations, the dial 18 is always below the top surface of the main body.

Embodiment 3

Figure 10:
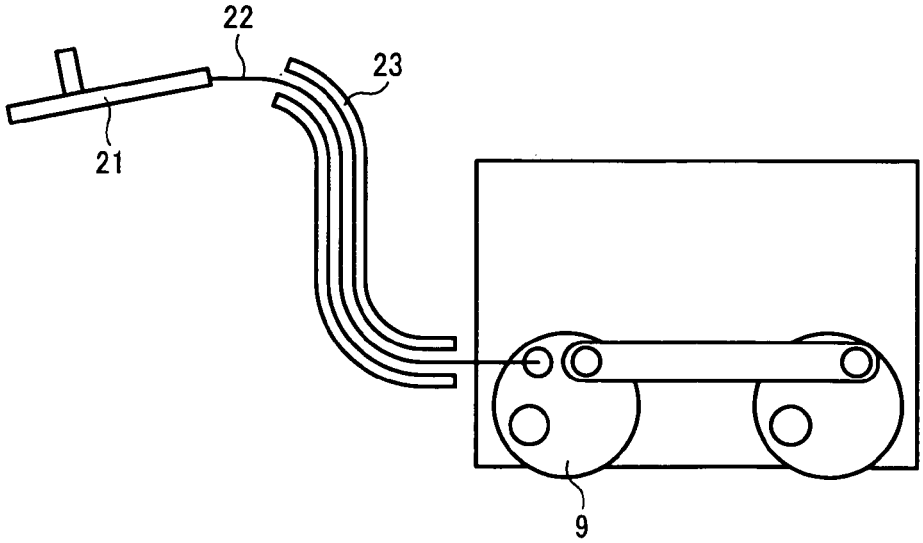
FIG. 10 is a diagram showing the relationship corresponding to FIG. 3 in Embodiment 3 of an image forming apparatus that applies the present invention.

FIG. 10 shows Embodiment 3 of the present invention, showing the relationship corresponding to FIG. 3, in which a sliding operation unit 21 is provided, and the sliding operation unit 21 is connected to the bearing 9 by a wire 22. The wire 22 is supported by a cylindrical shaped or groove shaped guide 23, so when the operation unit 21 slides, the bearing 9 rotates. In this way, even during operations, the operation unit 21 is always below the top surface of the main body.

Embodiment 4

Figure 11:
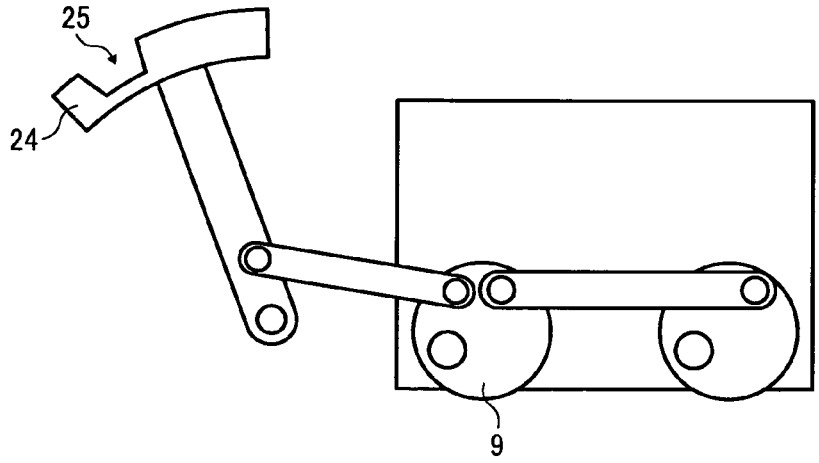
FIG. 11 is a diagram showing the relationship corresponding to FIG. 3 in Embodiment 4 of an image forming apparatus that applies the present invention.

FIG. 11 shows the relationship corresponding to FIG. 3 in Embodiment 4 of the present invention. In the present embodiment, the shape of the part where the finger is applied to an operation unit 24 is a depression shape 25, and even if the depression shape 25 is made larger to make it easier to apply the finger, the operation unit 24 does not project above the top surface of the main body.

Embodiment 5

Figure 12:
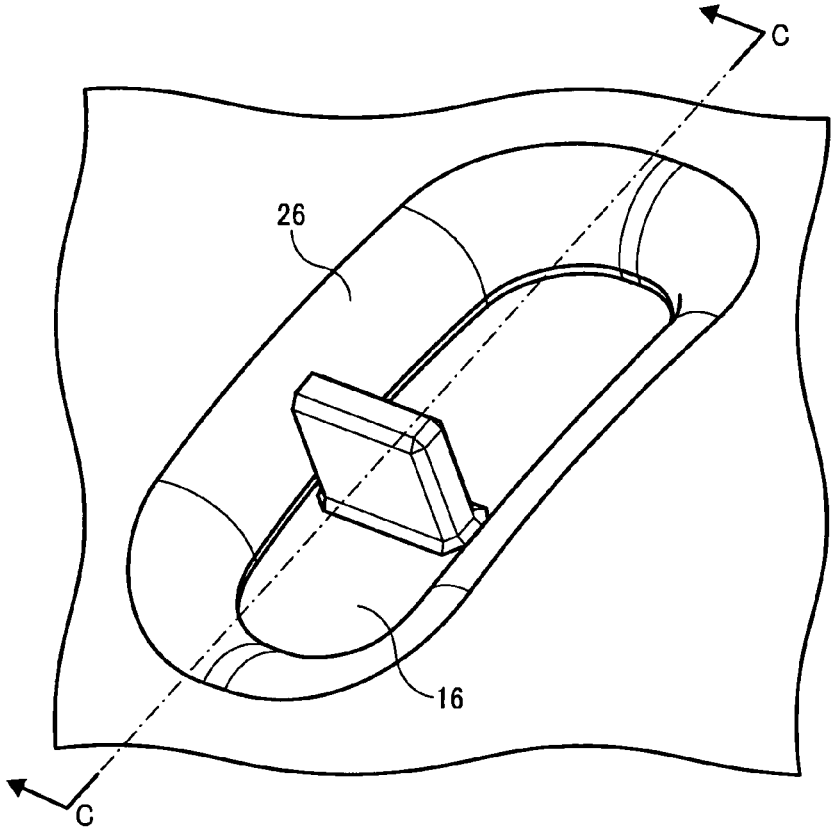
FIG. 12 is a perspective diagram showing the constitution of the apparatus main body in Embodiment 5 of an image forming apparatus that applies the present invention.
Figure 13:
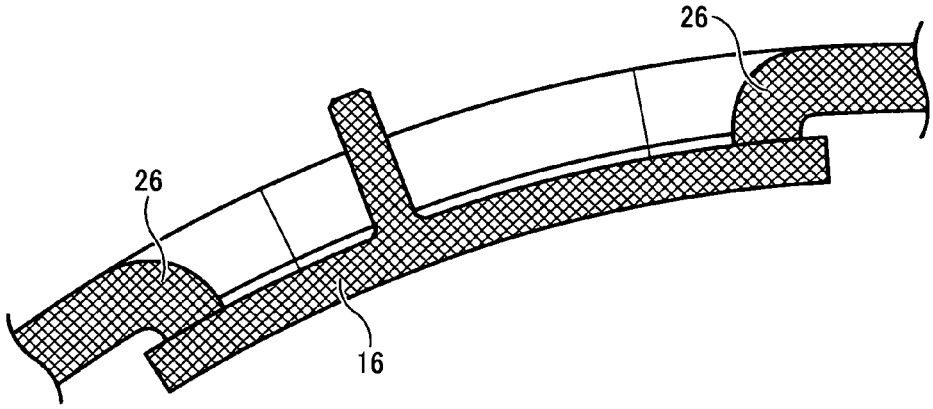
FIG. 13 is a cross-sectional diagram showing the constitution of the apparatus main body in Embodiment 5.

FIGS. 12 and 13 show the constitution of the apparatus main body in Embodiment 5 of the present invention. A circular arc portion 26 is provided on the edge of the hole 16 in the top surface of the apparatus main body, and by widening the aperture with the circular arc, the operator can easily grip the operation unit 11 even if the operation unit 11 is below the top surface of the apparatus main body.

Embodiment 6

Figure 14:
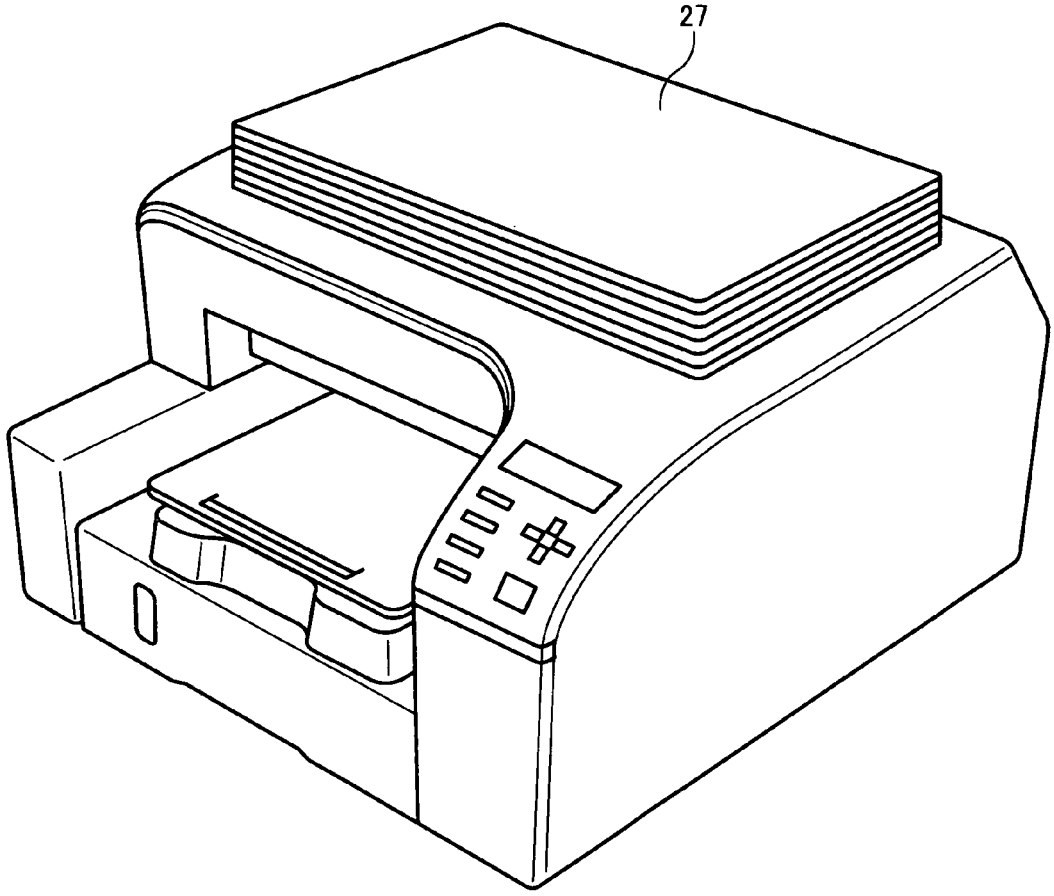
FIG. 14 is a diagram showing the state in which a plurality of sheets before recording or after recording are stacked on the top surface of the apparatus main body of an image forming apparatus that applies the present invention.

FIG. 14 shows an example of an image forming apparatus that applies each embodiment of the present invention as described above, showing the state in which a plurality of recording sheets 27 before recording or after recording are placed on the top surface of the main body. In other words, the operation unit on the top surface of the apparatus main body is lower than the surrounding plane, so even if sheets on which images have been formed or sheets before image forming are placed on the top surface of the apparatus main body, the operation unit will not be unintentionally operated. Therefore the settings of the apparatus will not be changed without the user noticing it, so it is possible to eliminate operations that the user did not intend.

According to the present invention, the operation unit on the top surface of the apparatus main body is lower than the surrounding plane, so when sheets on which images have been formed or sheets before image forming or the like are placed on the top surface of the apparatus main body, the operation unit will not be unintentionally operated, so the settings of the apparatus will not be changed without the user noticing it, so it is possible to eliminate operations that the user did not intend.

Various modifications will become possible for those skilled in the art after receiving the teachings of the present disclosure without departing from the scope thereof.

What is claimed is:

1. An image forming apparatus, comprising:

a flat portion forming substantially an entire top surface of a main body thereof;

an operation unit provided lower than the flat portion of the top surface of the main body when the flat portion is in a specific stop position; and an operation panel of the image forming apparatus, and a carriage having a recording head and moving in a direction orthogonal to a sheet transport direction, wherein the operation unit includes an operation lever that does not project above the top surface of the flat portion, and wherein the operation unit is disposed between the carriage and the operation panel of the apparatus main body.

2. The image forming apparatus as claimed in claim 1, wherein the flat portion of the top surface of the main body is larger than the largest sheet that can be used for image forming in the image forming apparatus.

3. An image forming apparatus, comprising:

a flat portion forming substantially an entire top surface of a main body thereof; and an operation unit provided lower than the flat portion of the top surface of the main body when the flat portion is in a specific stop position, wherein the operation unit includes an operation lever that does not project above the top surface of the flat portion, and wherein a guide hole that houses the operation unit is provided in the top surface of the main body, and the edge of the guide hole has a circular arc or sloping surface.

4. An image forming apparatus, comprising:

a flat portion forming substantially an entire top surface of a main body thereof;

an operation unit provided lower than the flat portion of the top surface of the main body when the flat portion is in a specific stop position; and an operation panel of the image forming apparatus, and a carriage having a recording head and moving in a direction orthogonal to a sheet transport direction, wherein the operation unit is disposed between the carriage and the operation panel of the apparatus main body, and wherein when the carriage has moved as far as possible to the operation unit side, the operation unit is located closer to the center of the apparatus main body than the outside of the carriage.

5. The image forming apparatus as claimed in claim 3, wherein the operation lever is housed within the guide hole, and is operated by sliding within the guide hole.

6. The image forming apparatus as claimed in claim 1, wherein the image forming apparatus is an image forming apparatus using an inkjet process.

7. The image forming apparatus as claimed in claim 1, further comprising a carriage having a recording head and moving in a direction orthogonal to a sheet transport direction.

8. The image forming apparatus as claimed in claim 7, wherein the carriage is guided by a pair of guide shafts to move in a direction that the guide shafts extend and performs reciprocating scans over a recording area.

9. The image forming apparatus as claimed in claim 8, wherein the pair of guide shafts are supported by bearings that can rotate in a sheet transport direction.

10. The image forming apparatus as claimed in claim 1, wherein the operation unit is connected to a side plate of a main body by a rotation shaft.

11. The image forming apparatus as claimed in claim 10, further comprising a pair of guide shafts, a first and second bearings, and a first and second linking members.

12. The image forming apparatus as claimed in claim 11, wherein:

a connection portion between the first bearing and the first linking member can rotate, so that when the operation unit is moved, the first bearing is rotated; and a connection portion between the second bearing and the second linking member can rotate, so that when the operation unit is moved, the second bearing is rotated.

13. The image forming apparatus as claimed in claim 1, further comprising a platen belt provided below a carriage having a recording head.

14. The image forming apparatus as claimed in claim 13, wherein a pair of guide shafts are inserted at positions that are offset from rotation centers of a respective bearings, so that when the bearings rotate, a distance between the pair of guide shafts and the platen belt varies.

* * * * *